United States Patent [19]

Nakanishi

[11] Patent Number: 4,581,687

[45] Date of Patent: Apr. 8, 1986

[54] LIGHTING MEANS FOR ILLUMINATIVE OR DECORATIVE PURPOSE AND MODULAR LIGHTING TUBE USED THEREFOR

[75] Inventor: Hirobumi Nakanishi, Kawagoe, Japan

[73] Assignee: ABC Trading Company, Ltd., Japan

[21] Appl. No.: 610,749

[22] Filed: May 16, 1984

[51] Int. Cl.[4] ..... H01R 33/00; H01R 11/22; F21P 1/00

[52] U.S. Cl. ..... 362/226; 362/250; 362/252; 362/278; 362/320; 362/800; 362/806; 339/252 R; 339/252 S

[58] Field of Search ..... 362/249, 250, 252, 278, 362/226, 320, 800, 806; 339/252 R, 252 S

[56] References Cited

U.S. PATENT DOCUMENTS

| | | | |
|---|---|---|---|
| 2,107,641 | 2/1938 | Malcolmson | 362/249 |
| 2,110,353 | 3/1938 | Barkes | 362/249 |
| 3,714,414 | 1/1973 | Sternius | 362/249 |
| 3,755,663 | 8/1973 | George, Jr. | 362/249 |
| 4,107,767 | 8/1978 | Anquetin | 362/249 |
| 4,143,411 | 3/1979 | Roberts | 362/145 |
| 4,177,503 | 12/1979 | Anquetin | 362/249 |
| 4,263,640 | 4/1981 | Altman | 362/252 |
| 4,271,458 | 6/1981 | George, Jr. | 362/249 |
| 4,376,966 | 3/1983 | Tieszen | 362/249 |
| 4,413,311 | 11/1983 | Orenstein | 362/249 |

FOREIGN PATENT DOCUMENTS 54-11086 1/1979 Japan .

54-89082 6/1979 Japan .

*Primary Examiner*—Stephen J. Lechert, Jr.
*Assistant Examiner*—Howard J. Locker
*Attorney, Agent, or Firm*—Lowe, Price, Leblanc, Becker & Shur

[57] ABSTRACT

The modular lighting tube according to the present invention comprises a transparent or translucent and flexible tubular member, a pair of circuit wires provided within said tubular member, across which a plurality of light emitting means are connected, electric terminals for said pair of circuit wires and mechanical connector members provided on opposite ends of said tubular member, wherein the last-mentioned two components are directly connectable to the ends of the adjacent modular lighting tubes in electro-mechanical manner. The circuit wires are connected to the terminals therefor by spring structures to maintain tension in the wires. The springs may form portions of the respective circuit wires. The modular lighting tube thus constructed is electro-mechanically connected to the mounting base and then a single or a plurality of other modular lighting tube or tubes is or are directly connected to one or both ends of said first modular lighting tube in a linear or curved row to obtain an assembly of different length and configuration as an excellently decorative lighting device. The spring portions of the circuit wires serve to keep the wires under tension during formation and use of the lighting device, whether the tube or tubes are linearly or curvedly arranged.

18 Claims, 12 Drawing Figures

LIGHTING MEANS FOR ILLUMINATIVE OR DECORATIVE PURPOSE AND MODULAR LIGHTING TUBE USED THEREFOR

FIELD OF THE INVENTION

The present invention relates to an improvement in lighting means for illuminative or decorative purpose and, more particularly, to a modular lighting tube constituting such lighting means as well as to lighting means comprising an assembly of these modular lighting tubes.

BACKGROUND OF THE INVENTION

Both for places where a decorative effect and a mood-producing effect are desired, such as hotel, restaurant, various kinds of club and theatre, and for private dwelling and office, especially in front hall, drawing room, etc. thereof, said decorative and mood-producing effects are required for lighting, in addition to the illuminative effect proper. As the lighting suitable for the above-mentioned places, a combination, for example, of chandeliers, louvers, mini-lamps and special globes is well known. However, such prior art lighting principally relies upon the light intensity of individual lamps and is designed rather as a purely illuminative means. Furthermore, such well known lighting systems produce decorative effect by arranging independent modular light emitting elements or individual lamps in accordance with a predetermined pattern defined in a space by combining these light emitting elements or lamps with separately provided decorative objects.

A lighting device has already been proposed which, although useful also for illuminative purpose, is rather suitable for the places where the decorative and mood-producing effects are important rather than the light intensity. Such adevice is disclosed, for example, in Unexamined Disclosure of Japanese Utility Model Application No. 54-159778 in which a modular lighting structure comprises a plurality of minilamps arranged at suitable intervals and electrically connected to one another within a suitable length of inflexible, transparent pipe and these modular lighting structures each serving as a lamp bulb are assembled according to a desired pattern. Unexamined Disclosure of Japanese Utility Model Application No. 54-11086 discloses another proposal by which a plurality of modular lighting tubes, each comprising a plurality of mini-lamps are arranged within a transparent pipe previously curved into a ring-shape, are electro-mechanically connected to a lamp-cassette. Thus, the assembly of modular lighting structures each comprising the ring of a large circumferential dimension containing therein a plurality of mini-lamps is realized which is excellent not only in its illuminative effect but also in its decorative effect, produced when the light is turned on.

However, such lighting devices of prior art disclosed in both the above-identified applications are inconvenient in that the pipes are inflexible and therefore have no freedom of their configuration changes. More specifically, these pipes are prefabricated in predetermined configurations and lengths depending upon the particular places of their installation, so that the products of the correspondingly particular configurations and dimensions must be ordered and fabricated.

To avoid such inconvenience, an improved modular lighting tube for lighting device has been proposed, for example, by Unexamined Disclosure of Japanese Utility Model Application No. 54-89082, according to which a plurality of mini-lamps are arranged within a flexible, long tube of transparent synthetic resin. In this proposal, respective pairs of adjacent mini-lamps are electrically connected to one another by elastic conductors so that, even when said elastic conductors constituting the circuit wires for the interior mini-lamps are subjected to a tension as the tube itself is bent, said elastic conductors are effectively extended to avoid a stress concentration which otherwise would result in a wire breakage.

Nevertheless, all of these disclosures are principally based on the illuminative function of the independent modular lighting structures and have no suggestion of continuously connecting the modular lighting structures, each relatively long, into a single but longer lighting structure. Even if it is desired to form such a long lighting device from a plurality of modular lighting structures, the respective adjacent modular lighting structures should be connected by separately provided intermediate connector members to one another, or these modular lighting structures should be merely arranged in a row and put on light so that they appear as if they are continuous. Any way, the portions destined for connection would be occupied by the intermediate connector members quite different from the modular lighting structures in their configuration, material and color and the electrical circuit wires associated with these intermediate connector members, or would be void, so that the modular lighting structures really would be intermittently arranged. Such lighting device consisting of thus intermittently arranged modular lighting structures would be undersirable with respect to its decorative effect.

The continuous arrangement as mentioned above necessarily results in increase of impressed voltage to obtain the minimum limit of power when the mini-lamps contained therein are connected in series as a whole, or can not be compatible with the commerical power supply unless larger bulbs are used, when connected in parallel. In the latter case, the arrangement would be suitable for the illuminative purpose rather than for the decorative purpose.

Furthermore, the modular lighting structures of prior art must, without exception, be provided on opposite ends with electrodes and the exposed connecting cords would spoil the aesthetic effect when it is desired to use the arrangement for the decorative purpose, for example, in a chandelier.

SUMMARY OF THE INVENTION

A first object of the present invention is to provide a modular lighting tube as a component of lighting means for illuminative or decorative purpose, which is flexible and can be connected to adjacent identical modular lighting tubes in direct and visually continuous manner so as to form a single tubular lighting structure of configuration and length depending on the number of the modular lighting tubes being thus connected to one another.

A second object of the present invention is to electro-mechanically connect said tubular lighting structures of variable configuration and length to a mounting base and to provide lighting means for illuminative or decorative purpose in accordance with planar or spatial various patterns.

A third object of the present invention is to provide a modular lighting tube within which electrical circuit wires are free from a possibility of breakage and relative position of light emitting means is never affected when said modular lighting tube is bent.

A fourth object of the present invention is to provide a modular lighting tube which is easily fabricated.

A fifth object of the present invention is to provide a modular lighting tube facilitating electro-mechanical direct connection to adjacent modular lighting tubes.

A sixth object of the present invention is to specify how a plurality of light emitting means are arranged in mutually connected modular lighting tubes and thereby to improve a decorative effect.

These objects of the present invention are achieved by a lighting device for illuminative or decorative purpose including a mounting base provided with connector means, and a group of modular lighting tubes electro-mechanically directly connected to one another and/or to said connector means, said modular lighting tube comprising: a tubular member made of transparent and heat resistant material having a flexibility; mechanical connector means having one end fixedly carried by an end of said tubular member and the other end being mechanically connectable, selectively, to the mechanical connector means provided on one end of an adjacent modular lighting tube or said associated connector means of said mounting base; two pairs of electric terminal means each pair carrying two electric terminals provided on opposite ends of said tubular member so as to be electrically connectable, selectively, to ends of the adjacent modular lighting tubes or to said associated connectors of said mounting base; electrical connection means associated with each pair of said electric terminal means, inclusive of circuit wires electrically connecting said two electric terminals of each pair of said electric terminal means, wherein each of said circuit wires partially comprises a tension-elastic conductor; and a plurality of light emitting means electrically connected across said circuit wires within said tubular member; and said groups of modular lighting tubes constructing a lighting assembly of one or more sets of modular lighting tubes each set consisting of a series of electro-mechanically and directly connected by mutually associated said connector means and electric terminal means of respectively adjacent modular lighting tubes or a single modular lighting tube so as to serve a lighting structure in a manner of predetermined planar or spatial pattern.

PREFERRED EMBODIMENT OF THE INVENTION

Figure 1:
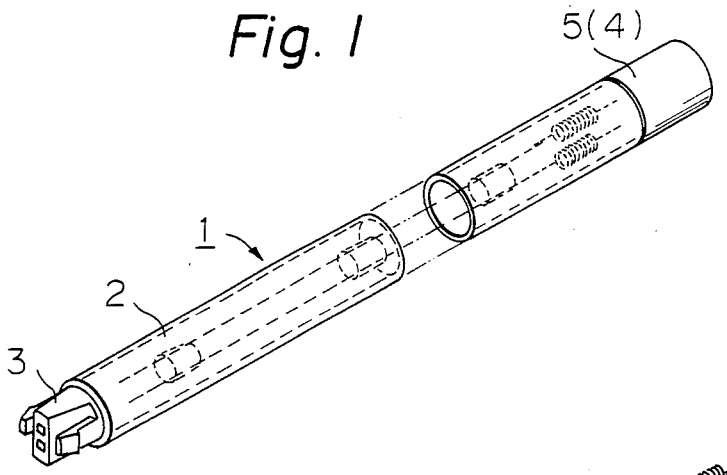
FIG. 1 is a perspective view showing an embodiment of a modular lighting tube constructed according to the present invention.
Figure 2:
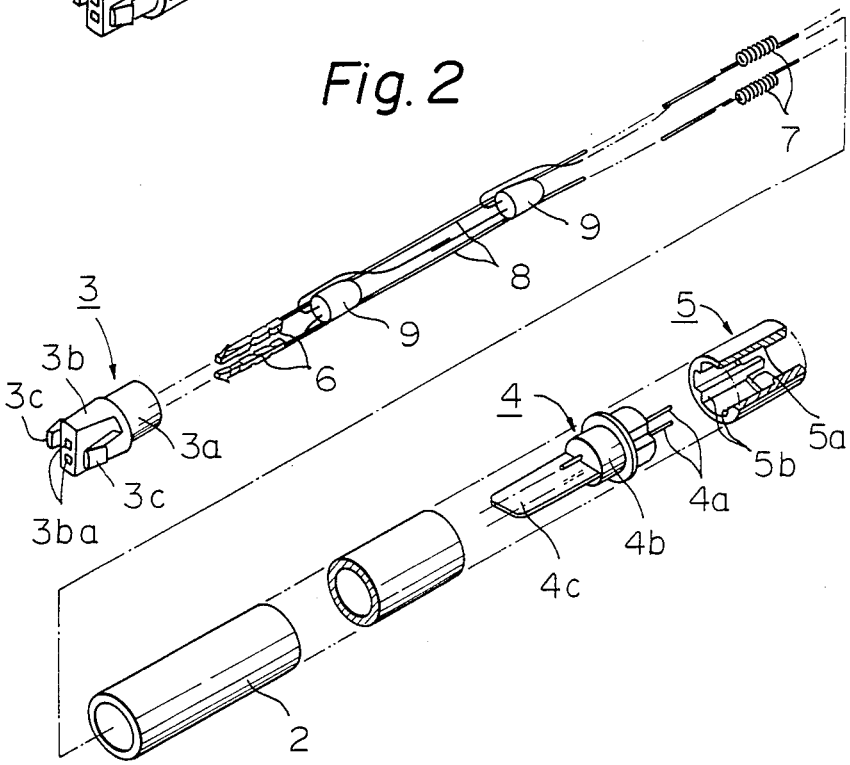
FIG. 2 is a perspective view showing the modular lighting tube of FIG. 1 as decomposed into components.

Referring to FIGS. 1 through 4, a modular lighting tube 1 serving as a module for lighting means according to the present invention comprises a length of tube 2 made of transparent, heat-resistant and flexible material, containing therein various lighting components as will be described later. The tube or tubular member 2 may be molded, from transparent resin high in heat resistance as well as flexibility such as polycarbonate resin, into a flexible straight tube having, for example, a diameter of 10 mm and a length of 1 m.

A receptacle 3 serving as a component of the mechanical connector member is made of same material and has the same transparency as well as heat-resistance as the tubular member 2. The receptacle 3 is provided at one end with a diameter-reduced bushing 3*a* adapted to be adhesively fitted into said tubular member 2 and at the other end with an electric connector portion 3*b* having a pair of openings adapted to be associated with a pair of socket contacts 6 as will be described later. Said connector portion 3*b* is formed on laterally opposite sides with a pair of male snapping locks 3*c*, 3*c* serving as mechanical connector elements having their basic portions integral with said portion 3*b* and their axially extending free ends being elastically flexible.

A plug 4 including a pair of pins 4*a* serving as components of electric terminals axially extending is made of the same material and has the same transparency as well as heatresistance as the tubular member 2. The plug 4 is provided at its inner end with a connector piece 4*b* destined to be adhesively fitted into the other end of the tubular member 2 and further with an insulator plate 4*c* formed integrally therewith to electrically insulate said pair of pins 4*a* from each other. A guide cover 5 made of the same material and having approximate the same diameter as well as transparency as the tubular member 2 is provided on its inner side with steps 5*a* adapted to be engaged with the respective snapping locks 3*c* of the receptacle 3 of an adjacent tubular member and ridges 5*b* to limit any angular movements of the electric connector portion 3*b*, i.e., its snapping locks 3*c* when they are inserted thereinto. The guide cover 5 is forcibly fitted around the outer end of the plug 4 and then adhesively fixed thereon to complete the mechanical connector member.

The pair of socket contacts 6 forming other components of the electric terminals respectively include jack portions 6*a* into which the pins 4*a* associated with the adjacent modular lighting tube 1 and serving as the electric terminals are detachably inserted, abutment portions 6*b* against which a pair of circuit wires 8 are secured, and snapping locks 6*c* adapted to be engaged with recesses 3*bb* of the receptacle 3 after inserted into openings 3*ba* of the receptacle.

The pair of circuit wires 8, 8 serving as electrical connector means partially comprise tension springs 7, 7 having respective ends welded to the respective inner ends of the pin 4*a*, 4*b* of the plug 4 and the other ends of said pair of circuit wires 8, 8 are securely forced against the respective socket contacts 6, 6. Specifically, there are provided a pair of such circuit wires 8, 8 each of which functions to establish electric connection of the electric terminals provided on opposite sides of the tubular member 2.

A plurality of mini-lamps 9, arranged as light emitting means within said tubular member 2, are serially connected by welding across said pair of circuit wires 8, 8. It should be noted here that it is preferred to arrange the mini-lamps 9 at regular intervals and also to arrange so that the outermost mini-lamps 9 of the modular lighting tube 1 are spaced from the associated outermost mini-lamps 9 of the adjacent modular lighting tubes 1 substantially by said regular intervals of the mini-lamps 9 within the same and one modular lighting tube 1. It may be also possible that a plurality of groups, each group comprising a plurality of mini-lamps 9 serially connected across the pair of circuit wires 8, 8, are arranged across these circuit wires 8, 8.

Assembly of the modular lighting tubes 1 each constructed as has been described may be accomplished, for example, in a manner as will be mentioned. The guide cover 5 is fitted around the plug 4 and then fixed with suitable adhesive. Said adhesive may be dropped into a through-hole formed in the cover 5 at a portion fitted on the corresponding portion of the plug 4 to achieve these both associated portions. This is true also of other positions at which the similar adhesive fitting must be carried out. Then respective one ends of the springs 7,7 are connected by welding to the respective pins 4*a* projecting from the plug 4 while respective one ends of the circuit wires 8 are connected also by welding to the other ends of said springs 7. One end of a plurality of mini-lamps 9 previously connected in series with their terminals by spot welding at regular intervals is connected by spot welding to a junction point of the one circuit wire 8 and the associated spring 7 while the other end of said previously connected mini-lamps 9 is connected also by spot welding to the free end of the other circuit wire opposite to a junction point of the circuit wire 8 and the associated spring 7. The socket contacts 6 are respectively connected by pressing to the respective free ends of the circuit wires 8.

Figure 3:
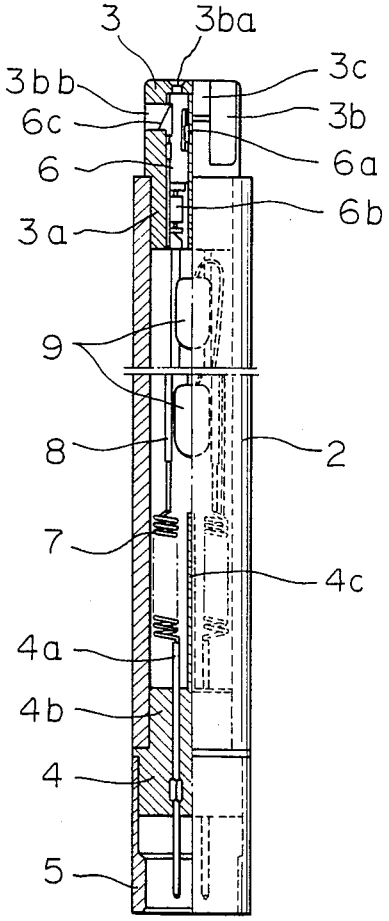
FIG. 3 is a sectional view showing, in enlarged scale, an important part of the modular lighting tube of FIG. 1.
Figure 4:
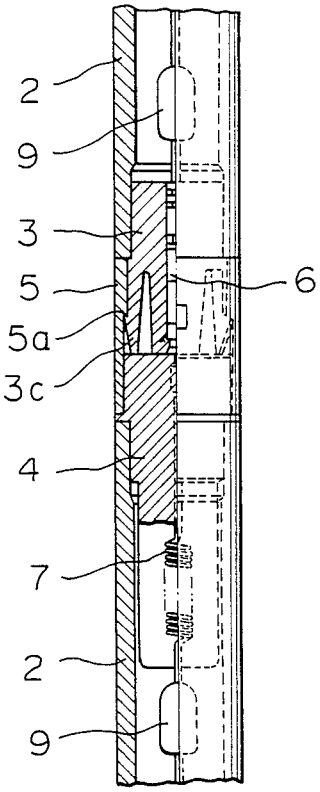
FIG. 4 is a sectional view showing, in enlarged scale, components of the modular lighting tube according to the present invention.
Figure 12:
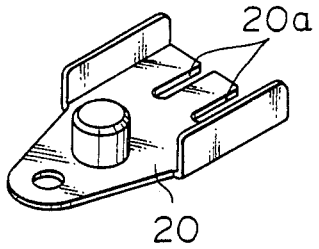
FIG. 12 is a perspective view showing a jig used for assembly of a plurality of the modular lighting tubes according to the present invention.

The inner lighting structure connected and constructed in this manner is inserted from the side of the contacts 6 into the tubular member 2 and then the connector piece 4*b* of the plug 4 is adhesively fitted into said tubular member 2. In this condition, front ends of the contacts 6 lie within the tubular member 2 more or less behind the open end of said tubular member 2. Using a jig or the like having a hook-like end (not shown), the contacts 6 are caught and withdrawn against the effect of the springs 7, 7 out of the tubular member 2. Then, a jig stopper 20 larger than the inner diameter of the tubular member 2 as shown in FIG. 12 is inserted into said tubular member 2 so that the circuit wires 8, 8 are respectively engaged into slits 20*a* of said stopper 20 and then said contacts 6 are relieved of the withdrawing force. As a result, the contacts 6 are pulled inwardly under the effect of the springs 7 towards the interior of the tubular member 2, but the stopper 20 together with the ends of the circuit wires 8, 8 engaged therewith are stopped by the end surface of the tubular member 2 and prevent the circuit wires 8, 8 from being retracted into the tubular member 2. Now the contacts 6 thus projecting from the tubular member 2 are fitted into the openings 3*ba* of the receptacle 3 to connect both these components so that the snapping locks 6*c* of the contacts 6 may be engaged with the respective recesses 3*bb* in the plug member and thereby the latter may be fixedly connected to the contacts 6. In consequence, the stopper 20 may be now disengaged to leave the plug 3 be pulled by the springs 7 towards the tubular member 2 until the bushing 3*a* is fitted into the tubular member 2 to establish a complete assembly as shown by FIG. 3. It should be understood that the tubular member 2 and the bushing 3*a* are mutually fixed to each other with adhesive.

By fitting the receptacle 3 into the plug of an adjacent modular lighting tube 1, the snapping locks 3*c* of the receptacle 3 are flexibly inserted thereinto and then elastically engaged with the respective steps 5*a* of the guide cover 5. Thus a plurality of modular lighting tubes 1 may be easily connected to one another to be integrated in a longer dimension.

The pins 4*a* also are inserted into the socket contacts 6 and at the same time a plurality of mini-lamps 9 contained in a plurality of modular lighting tubes 1 thus connected in a row are electrically connected to one another. When the mini-lamp 9 located at the end of one modular lighting tube 1 is spaced from the mini-lamp 9 located at the end of the adjacent modular lighting tube 1 which is adjacent to said end of the first-mentioned modular lighting tube 1 by the same interval as the interval at which each pair of adjacent mini-lamps are spaced from each other within the same and one modular lighting tube 1 when said mutually associated ends of these modular lighting tubes are mechanically connected to each other, all the mini-lamps 9 contained in a plurality of modular lighting tubes thus connected in a row are arranged at regular intervals and a preferred decorative effect is provided.

With the tubular member 2 being curved during use, the circuit wires 8 are certainly subjected to a tension or a compression due to the abovedescribed curving operation since these wires 8 are provided eccentrically with respect to the axis of the tubular member 2, but such tension or compression is effectively absorbed by expansion and contraction of the springs 7, since the circuit wires 8 are provided under a slight tension by said springs 7, so that such use of the tubular member 2 in a curved condition never affect the circuit wires themselves, junction points and other parts associated therewith and thereby avoid a trouble which otherwise would be possible.

The receptacle 3, the plug 4 and the guide cover 5 constituting the connector member for each modular lighting tube 1 are made of same material and have the same transparency as well as the same diameter as the tubular member 2. This feature is advantageous in that, even when a plurality of modular lighting tubes 1 are connected to one another in a longer dimension, the diameter is kept constant along the full length and a smooth, integral assembly without any intermediate unevenness is obtained. When the mini-lamps contained in the respective modular lighting tubes 1 thus assembled are turned on, light emission without any feeling of disorder is obtained from a row of mini-lamps arranged at regular intervals.

Of course, it is also possible that the mini-lamps are arranged in accordance with a predetermined rule to represent a unit pattern within each modular lighting tube and a plurality of modular lighting tubes 1 are connected to one another as above mentioned in a row so as to repeat said unit pattern. In this manner, an interesting and effectively decorative pattern is achieved which is different from the case in which the mini-lamps are arranged at regular intervals as has previously been described.

With a plurality of modular lighting tubes connected in a row, connection of a power source to one of the outermost sockets 6, 6 or pins *4a*, *4a* causes electric current to flow from one of the circuit wires, each circuit wire comprising a plurality of wire sections connected to one another in a row, through the mini-lamps connected across a pair of wires to the other of the circuit wires, assuring that these mini-lamps are turned on. As a consequence, it is unnecessary to supply electric current at opposite ends of an assembly comprising a plurality of modular lighting tubes in a row and this correspondingly simplifies wiring, improves a degree of freedom to select how a plurality of modular lighting tubes are combined, and prevents the connection cords from being exposed.

The internally arranged mini-lamps 9 can be directly connected to the commercial supply source of 110–120 V when 22 mini-lamps 9, for example, approximately of rate 5 V and 0.5 W are connected in series across the pair of circuit wires 8, 8 within each modular lighting tube 1. In this case, each modular lighting tube may be 1 m long as has previously mentioned. Also when the modular lighting tubes shorter than 1.2 m, for example, of 40 cm are used, the assembly can be directly connected to the commercial supply source of 110–120 V as the previous case, so far as 8 mini-lamps 9 approximately of rated 15 V and 1 W are connected in series across the pair of circuit wires within each modular lighting tube in the same arrangement as in the case of said tube of 1.2 m. Furthermore, it is possible to make light emission from the mini-lamps of both rates substantially uniform so that these mini-lamps of different rates may be used in mutually connected condition.

In this manner, it is possible to connect in series across the pair of circuit wires the number of mini-lamps which is optimal from a view point of relationship between an impressed voltage and a type of used lamp. One or more such serial connections may be provided in each modular lighting tube. Even when a plurality of modular lighting tubes are directly connected in a row, such serial connection makes it possible to obtain the same light emission from each mini-lamp as in the case of a single modular lighting tube used, with the same supply voltage.

When a single mini-lamp is connected across the pair of circuit wires and these unit connections are connected in parallel, supply voltage would be directly impressed to the single mini-lamp and this would make it impossible to use mini-lamps of relatively low watt. On the other hand, serial connection of the mini-lamps by a single circuit wire would disadvantageously require that the supply voltage be increased depending on the number of modular lighting tubes connected to one another in order to assure desired uniform light emission from the mini-lamps.

The modular lighting tube as has been described hereinabove may take various configurations of lighting depending on the number of modular lighting tubes or the length of the assembly thereof as well as various shapes in which the modular lighting tubes are curved. Several examples are illustrated by FIGS. 5 through 8.

Figure 5:
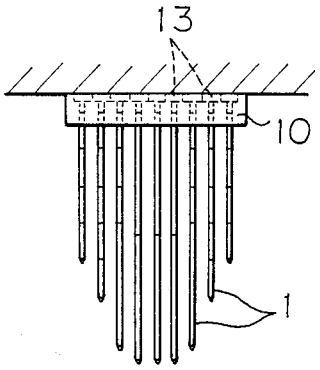
FIGS. 5 through 7 are elevational views respectively showing lighting devices assembled in various manners in which a plurality of the modular lighting tubes according to the present invention are connected to a mounting base.

In FIG. 5, a plurality of modular lighting tubes are connected to obtain many groups of linear assemblies respectively having different lengths. These groups are spatially arranged and electro-mechanically connected to the mounting base 11 which is, in turn, fixed to a building and connected to the supply source so as to form a chandelier-like lighting device.

Figure 6:
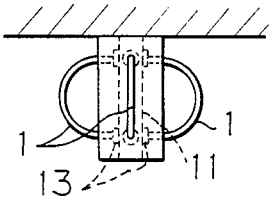

In FIG. 6, a plurality of modular lighting tubes are respectively curved in circular arcs and radially arranged with respect to a central axis in electro-mechanical connection to the mounting base 11 to form a downlight.

Figure 7:
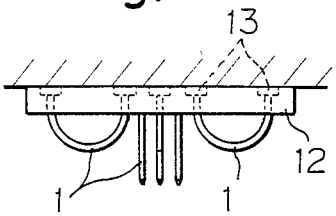

In FIG. 7, a plurality of modular lighting tubes 1 are linearly hung in electro-mechanical connection to the similar mounting base and a plurality of modular lighting tubes respectively curved in circular arcs are radially arranged around said linearly hung modular lighting tubes to form a lighting device of component type.

Figure 8:
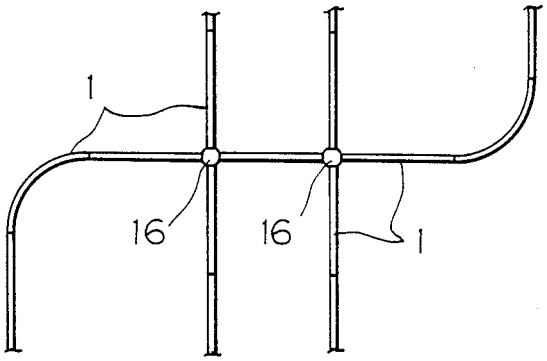
FIG. 8 is a bottom view showing a lighting device assembled in another manner in which a plurality of modular lighting tubes are connected to the mounting base.

In FIG. 8, the modular lighting tubes respectively remaining linear or curved in round shape are connected by way of a union to one another and on ceiling, side wall and like.

Figure 9:
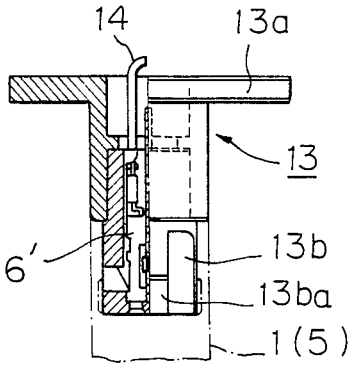
FIG. 9 is an elevational section showing an embodiment of the mounting base according to the present invention.
Figure 10:
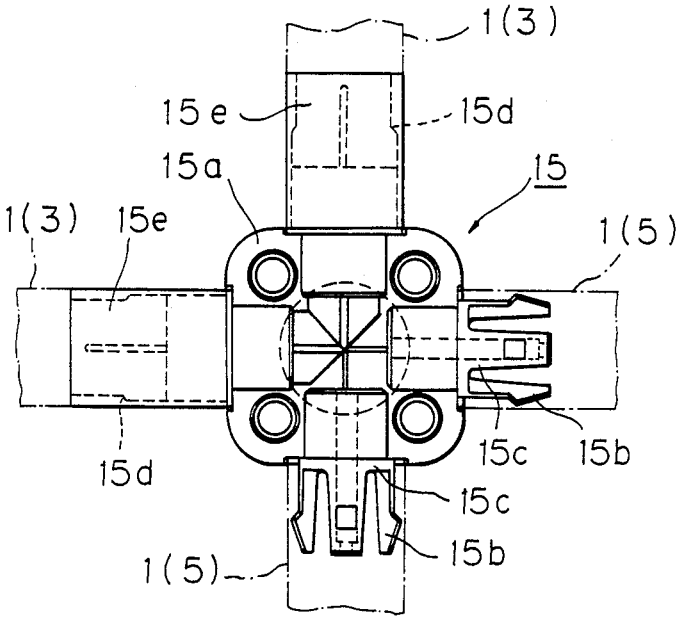
FIG. 10 is an elevational view showing the mounting base of FIG. 9 with a bottom cover being removed.
Figure 11:
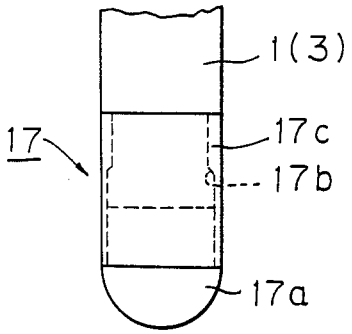
FIG. 11 is a frontal view showing an end cap provided at the outermost end of the modular lighting tube according to the present invention.

In arranging such various lighting devices, joints of the mounting bases 10 to 12 and the modular lighting tubes 1 as well as the free ends of the modular lighting tubes are dealt with means such as respective fittings and caps as shown by FIGS. 9 through 11.

Specifically, FIG. 9 partially shows a socket receptacle 13 provided in the mounting base 12 for electro-mechanical connection of ends of the respective modular lighting tubes to the mounting bases 10, 11, 12. The receptacle 13 of the same construction as said receptacle 3 is integrated with fittings 13*a* to the mounting base 12 and contains therein socket contact 6' to which a power supply cord 14 is connected.

Therefore, the fitting 13*a* may be fixed at predetermined locations such as corresponding to the mounting bases 10, 11, 12 and the plugs 4 of the respective modular lighting tubes 1 may be fitted into the corresponding receptacles 13 to bring the snapping locks 13*ba* of the respective receptacles 13 into engagement with the corresponding steps 5*a* formed in the guide covers 5 of the respective modular lighting tubes 1 and thereby to lock the respective modular lighting tubes 1.

FIG. 10 shows a union 15 serving as the mounting base to establish a desired electro-mechanical connection at a cross point of a plurality of modular lighting tubes with a front cover removed. Plug blocks 15*e* each including a receptacle 15*c* having means such as a snapping lock 15*b* similar to one associated with said receptacle 3 and an engaging step 15*d* similar to said step 5*a* formed as a single piece with said guide cover 5 and said plug 4 are mounted on a main body 15*a* of said union 15 integrally therewith in a cross-shape. These plug blocks 15*e* are electrically connected to one another at a central portion (not shown) of said main body 15*a*. Accordingly, the receptacles 3 and the plugs 4 of the modular lighting tubes 1 may be engaged with the corresponding plug blocks 15*c* and the receptacles 15*b* of the main body 15*a* fixed at a given location to combine a plurality of modular lighting tubes 1 mutually connected in a cross-shape as shown by FIG. 8.

FIG. 11 shows an end cap 17 to cover the receptacle 3 which otherwise would be exposed at the end of the outermost modular lighting tube opposite to the mounting base when a plurality of modular lighting tubes are connected in a row. The end cap 17 has one end shaped as a semi-sphere 17*a* and the other end shaped as a guide cover 17*c* including an engaging step 17*b* similar to that in said guide cover 5, said guide cover 17*c* being adapted to be fitted around the lower receptacle 3 of the modular lighting tube 1 or like hung down as shown in FIGS. 5 and 7.

The receptacle 13, the union 15 and the end cap 17 shown by FIGS. 9 through 11 are preferably made of the same material as the tubular member 2.

It should be understood that the present invention is not limited to the embodiments as has been described hereinabove. For example, the modular lighting tube may have various lengths, diameters and cross-sections, so far as the tube is transparent or translucent. The mechanical connector member as well as the electric terminal means provided on opposite ends of the modular lighting tube may be arranged to be mutually engageable in male and female relationship or, in the same and one modular lighting tube, these member and means are constructed as female member and means while these member and means of the other modular lighting tube may be male member and means. The mechanical connector member may be, instead of the flexible snapping lock and the associated step as in the embodiment shown, of other types such as a screw type. Both the tubular member and the light emitting means may be colored. The light emitting means is not limited to the lamp-bulb and may be the other light emitting sources such as a light emitting diode. It is also obvious that such light emitting means may be placed not only indoors but also outdoors or even in water.

With the lighting device according to the present invention, as will be apparent from the aforegoing description, a plurality of modular lighting tubes may be used not only in the intermittent arrangement at the ordinary bulb intervals but also in the continuous row of these modular lighting tubes directly connected to one another. And the modular lighting tube may be curved into a desired shape since it comprises a flexible tubular member. Therefore, preparation of a single or a few types of modular lighting tube permits linear or curved assemblies of different lengths to be obtained by combining a plurality of such modular lighting tubes and to arrange these assemblies into various lighting devices easily, which present excellent decorative and mood-producing effects. The tubular members and the mechanical connector members are realized from transparent or translucent material with a same diameter so that the respective joint portions exhibit very smooth appearance and the assembly actually appears as a single elongate mass. Such a single-piece appearance can be emphasized by arranging the respective light emitting means at regular or other predetermined intervals within the respective modular lighting tubes, when a plurality of such modular lighting tubes are connected to one another in a row. This also enhances the decorative effect of the assembly. Even when a breakage of the electric connection occurs for one or some light emitting means, it suffices to exchange only the modular lighting tube or tubes corresponding to such trouble. Thus the manufacturing cost and the maintenance cost are effectively reduced due to mass-production of a few items.

Assembling of the modular lighting tube is extremely facilitated by interposition of elastic conductors and thereby the efficiency of operation is drastically improved, since simple jigs permit even non-skilled workers to assemble the modular lighting tubes without any troublesome operation. Said elastic conductors function to absorb an abnormal force exerted on the circuit wires themselves, the junction points thereof and the associated parts when the modular lighting tube is used in a curved condition. Thus, the inner components of the modular lighting tube are not affected by such force.

I claim:

1. Modular lighting tube adapted to be connected in a row of such modular lighting tubes by directly connecting adjacent tubes at mutually opposing ends thereof electro-mechanically for illuminative or decorative purpose, said modular lighting tube comprising:

a tubular member made of transparent, flexible, heat-resistant material;

connector means having one end fixedly carried by each end of said tubular member and the other end mechanically connected to an associated connector means of an adjacent modular lighting tube;

two pairs of electric terminal means each pair provided with two electric terminals on opposite ends of said tubular member so as to be electrically connected to the electric terminals of an adjacent modular lighting tube;

electrical connection means associated with each pair of said electric terminal means, inclusive of circuit wires electrically connecting said two electric terminals of each pair of said electric terminal means, wherein each of said circuit wires partially comprises a tension-elastic conductor; and a plurality of light emitting means electrically connected across said circuit wires within said tubular member.

2. Modular lighting tube according to claim 1, wherein said connector means is made of transparent material having a same outer diameter as that of said tubular member.

3. Modular lighting tube according to claim 1, wherein one of said connector means is fixedly adhered to an end of the tubular member.

4. Modular lighting tube according to claim 1, wherein said connector means respectively comprise a pair of mutually engageable male and female elements of which the one is mounted at one end and the other is mounted at the other end of the tubular member so that each pair of adjacent modular lighting tube may be directly connected by said male and female elements to each other.

5. Modular lighting tube according to claim 4, wherein said male element of said connector means comprises a plug member having one end fixedly adhered to one end of said tubular member and provided at the other end with elastic snapping locks while said female element of said connector means comprises a receptacle fixedly adhered to the other end of said tubular member and into which said elastic snapping locks are engaged.

6. Modular lighting tube according to claim 1, wherein said pair of electric terminal means comprise a pair of mutually engageable socket contact and attaching plug, said socket contact being mounted at one end and said attaching plug being mounted at the other end of said tubular member.

7. Modular lighting tube according to claim 5, wherein said pair of electric terminal means comprise a pair of mutually engageable socket contact and attaching plug adapted to be inserted thereinto, said socket contact being fixedly carried by said plug member and said attaching plug being fixedly carried by said receptacle.

8. Modular lighting tube according to claim 1, wherein said light emitting means include a mini-lamp.

9. Modular lighting tube according to claim 1, wherein said light emitting means include a light emitting diode.

10. Modular lighting tube according to claim 1, wherein a plurality of said light emitting means are connected in series across said two circuit wires.

11. Modular lighting tube according to claim 1, wherein a plurality of said light emitting means are connected in series across said two circuit wires and a plurality of respective serial connections of said light emitting means are connected in parallel to one another.

12. Modular lighting tube according to claim 1, wherein said light emitting means are arranged to regular intervals within said tubular member.

13. Modular lighting tube according to claim 4, wherein a plurality of said modular lighting tubes are directly connected to one another in a row, and a plurality of sets of said light emitting means are repeatedly arranged in a row, each set of said light emitting means being arranged at intervals given in accordance with a predetermined rule inclusive of regular intervals.

14. Modular lighting tube according to claim 4, wherein said pair of electric terminal means comprise a pair of mutually engageable socket contact and attaching plug, said socket contact being mounted at one end and said attaching plug being mounted at the other end of said tubular member.

15. Lighting device for illuminative or decorative purpose including a mounting base provided with connector means and a group of modular lighting tubes electromechanically directly connected to one another by said connector means and/or to said connector means selectively, said modular lighting tube comprising:

a tubular member made of transparent, flexible, heat resistant material;

mechanical connector means having one end fixedly carried by an end of said tubular member and another end mechanically connectable, selectively, to an associated mechanical connector means provided on one end of an adjacent modular lighting tube or to said associated connector means of said mounting base;

two pairs of electric terminal means each pair carrying two electric terminals provided on opposite ends of said tubular member so as to be electrically connectable, selectively, to the associated ends of adjacent modular lighting tubes or to the associated connectors of said mounting base;

electrical connection means associated with each pair of said electric terminal means, inclusive of circuit wires electrically connecting said two electric terminals of each pair of said electric terminal means, wherein each of said circuit wires partially comprises a conductor incorporating a tension spring means therein;

a plurality of light emitting means electrically connected across said circuit wires within said tubular member;

groups of said modular lighting tubes constructing a lighting assembly of one or more sets of modular lighting tubes each set consisting of a series of electro-mechanically and directly connected by mutually associated mechanical connector means and electric terminal means of respectively adjacent modular lighting tubes or a single modular lighting tube so as to serve a lighting structure in a predetermined planar or spatial pattern.

16. Modular lighting tube capable of being directly electro-mechanically connected at mutually opposite ends to an adjacent tube to form a row of modular lighting tubes for illuminative or decorative purposes, comprising:

a tubular member made of transparent, heat-resistant material and capable of being curved when used, mechanical connector means comprising a plug member, said plug member having one end fixedly adhered to one end of said tubular member and having elastic snapping locks at the other end thereof, said mechanical connector means further comprising a receptacle means fixedly adhered to the other end of said tubular member for engaging said elastic snapping locks, both said plug member and said receptacle means made of transparent material and having an outer diameter substantially identical with an outer diameter of said tubular member, two circuit wires arranged in parallel to one another in said tubular member, tension-elastic conductors forming respective parts of said two circuit wires, electrical connection means comprising a pair of socket contacts fixedly carried by one of said plug member and said receptacle means and a pair of attaching electric plugs fixedly carried by the other of said plug member and said receptacle means, said socket contacts and said attaching electric plugs being mutually engageable and being attached to opposite ends of said two circuit wires, and a plurality of light emitting means electrically connected across said circuit wires within said tubular member and arranged in accordance with a predetermined rule within said tubular member.

17. Modular lighting tube according to claim 16 wherein said attaching electric plugs of said electrical connection means are carried by said receptacle means of said mechanical connector means and said socket contacts of said electrical connection means are carried by said plug member of said mechanical connector means, thereby providing a male electrical connector in a female mechanical connector at one end of the modular lighting tube and a female electrical connector in a male mechanical connector at the other end of the modular lighting tube.

18. Lighting device for illuminative or decorative purpose including a mounting base provided with connector means and a group of modular lighting tubes electromechanically directly connected to one another by said connector means and/or to said connector means selectively, said modular lighting tube comprising:

a tubular member made of transparent, heat-resistant material and capable of being curved when used, mechanical connector means comprising a plug member, said plug member having one end fixedly adhered to one end of said tubular member and having elastic snapping locks at the other end thereof, said mechanical connector means further comprising a receptacle means fixedly adhered to the other end of said tubular member for engaging said elastic snapping locks, both said plug member and said receptacle means made of transparent material and having an outer diameter substantially identical with an outer diameter of said tubular member, two circuit wires arranged in parallel to one another in said tubular member, tension-elastic conductors forming respective parts of said two circuit wires, electrical connection means comprising a pair of socket contacts fixedly carried by one of said plug member and said receptacle means and a pair of attaching electric plugs fixedly carried by the other of said plug member and said receptacle means, said socket contacts and said attaching electric plugs being mutually engageable and being attached to opposite ends of said two circuit wires, and a plurality of light emitting means electrically connected across said circuit wires within said tubular member and arranged in accordance with a predetermined rule within said tubular member, said mounting base comprising:

second mechanical connector means engageable with said plug member or receptacle of said modular lighting tube, and second electrical connection means electrically connective with said socket contacts or said attaching electric plugs of said electrical connection means, groups of said modular lighting tubes constructing a lighting assembly of one or more sets of modular lighting tubes each set consisting of a series of lighting tubes electromechanically and directly connected by mutually associated mechanical connector means and electric terminal means of respectively adjacent modular lighting tubes or a single modular lighting tube so as to serve as a lighting structure in a predetermined planar or spatial pattern.

* * * * *